United States Patent [19]

Bonney et al.

[11] Patent Number: 4,514,204

[45] Date of Patent: Apr. 30, 1985

[54] BAKEABLE CRYOPUMP

[75] Inventors: Glenn E. Bonney; Ralph C. Longsworth, both of Allentown, Pa.

[73] Assignee: Air Products and Chemicals, Inc., Allentown, Pa.

[21] Appl. No.: 477,478

[22] Filed: Mar. 21, 1983

[51] Int. Cl.[3] ..... F17C 7/02

[52] U.S. Cl. ..... 62/41; 62/55.5; 62/268

[58] Field of Search ..... 62/6, 41, 55.5, 100, 62/268; 55/DIG. 15, 269

[56] References Cited

U.S. PATENT DOCUMENTS

| | | | |
|---|---|---|---|
| 3,620,029 | 11/1971 | Longsworth | 62/6 |
| 4,150,549 | 4/1979 | Longsworth | 62/55.5 |
| 4,219,588 | 4/1980 | Longsworth | 427/160 |

*Primary Examiner*—Frank Sever

*Attorney, Agent, or Firm*—James C. Simmons; E. Eugene Innis

[57] ABSTRACT

A bakeable cryopump having a housing and means to removeably receive the displacer end of a cryogenic refrigerator to cool internal cryopanels said cryopumps adapted for removal of the refrigerator without loss of vacuum inside the cryopump and further adapted to be heated under vacuum to remove pumped gases primarily water so that the cryopumps after cooling can be used at vacuum of at least $10^{-10}$ Torr.

14 Claims, 5 Drawing Figures

BAKEABLE CRYOPUMP

TECHNICAL FIELD

This invention relates to cryopumps for use in ultra-high vacuum regions, e.g., $10^{-10}$ to $10^{-12}$ Torr.

BACKGROUND OF THE ART

Cryopumps are utilized to capture gas molecules on extremely cold surfaces from enclosed volumes which have already been reduced to a very low pressure. Cryopumping can provide a clean vacuum at high pumping speeds economically in comparison to conventional pumping techniques. In particular, standard cryopumps can not be operated below $10^{-10}$ Torr because the materials of construction used do not permit them to be baked out and in some cases; e.g., brazing alloys, have relatively high outgassing rates. Bakeout is necessary to remove water vapor from the system. The materials of construction of the crypump usually include stainless steel, which contains hydrogen entrapped within the steel during its manufacture. At extremely high vacuums (low pressure) hydrogen contained within the steel begins to migrate into the interior of the vacuum chamber. In order to achieve very high vacuums, it is necessary to first bake out the cryopump to remove water vapor, then after it is cold, it must be able to entrap hydrogen. Normally hydrogen is removed in a bed of absorbent such as charcoal, which is cooled to an extremely low temperature (e.g., 12° K). High pumping speeds have been achieved with a double nested can configuration for the cryopanels, such as shown in U.S. Pat. Nos. 4,150,549 and 4,219,588. In the prior art patents a chevron or warm baffle is eliminated, thus, providing increased pumping speeds for gases such as helium, hydrogen, and neon.

BRIEF SUMMARY OF THE INVENTION

In order to provide a cryopump that can be used in the ultra-high vacuum region of $10^{-10}$ to $10^{-12}$ Torr. it is necessary to first pump any residual gases from the vacuum chamber and cryopump to an initial vacuum of approximately $1\times10^{-6}$ Torr. This is done by baking the vacuum chamber and cryopanels while under a vacuum in order to remove gases, primarily water, which are adsorbed on the surfaces of the vacuum chamber, cryopanels and related equipment. Heating these surfaces to a temperature of 250° C. or more is required to remove the residual gases. The heating is then discontinued, and the cryopanels cooled to low temperature in order to pump the residual gases, primarily hydrogen which outgases from the materials of construction of the cryopump, to lower the vacuum chamber pressure to the required range of $10^{-10}$ to $10^{-12}$ Torr. One way of achieving an apparatus of this type is to provide for removal of the displacer end of a cryogenic refrigerator normally used to cool the cryopanels as they are being baked. Removal of the refrigerator makes it possible to use conventional materials of construction for the refrigerator which would otherwise be severly damaged during the heating operation. The cryopump portions subject to heating are fabricated with special techniques such as electron beam welding to prevent the use of conventional brazing alloys which outgas significantly at pressures below $10^{-11}$ Torr. The refrigerator being removed from the heated portion of the vacuum chamber can be used through a non-heated port to continue pumping as the cryopump is heated, thus eliminating the need for a separate ion pump.

The cryopanel geometry can be tailored specifically for use at ultra-high vacuums where hydrogen is usually the only significant gas present, and radiant heat loads are extremely low because enclosures are usually fabricated from electro-polished stainless steel. In order to effectively pump hydrogen, the charcoal must be kept as cold as possible. At ultra-low pressures, the predominant mechanism for transporting heat from the loose charcoal to the cryopanel is by radiation. The cold panel is constructed with an internal baffle which is black and shaped so that most of the charcoal sees only surfaces that are within a few degrees of the refrigerator's second stage (coldest) temperature. The heat load on the second stage is minimized by having the outer surface of the cryopanels polished to reflect radiation and by having a black coating on the inside of the warm cryopanel to absorb room temperature radiation that otherwise might be reflected from the warm to the cold panel.

DETAILED DESCRIPTION OF THE INVENTION

Figures 1, 2, 5:
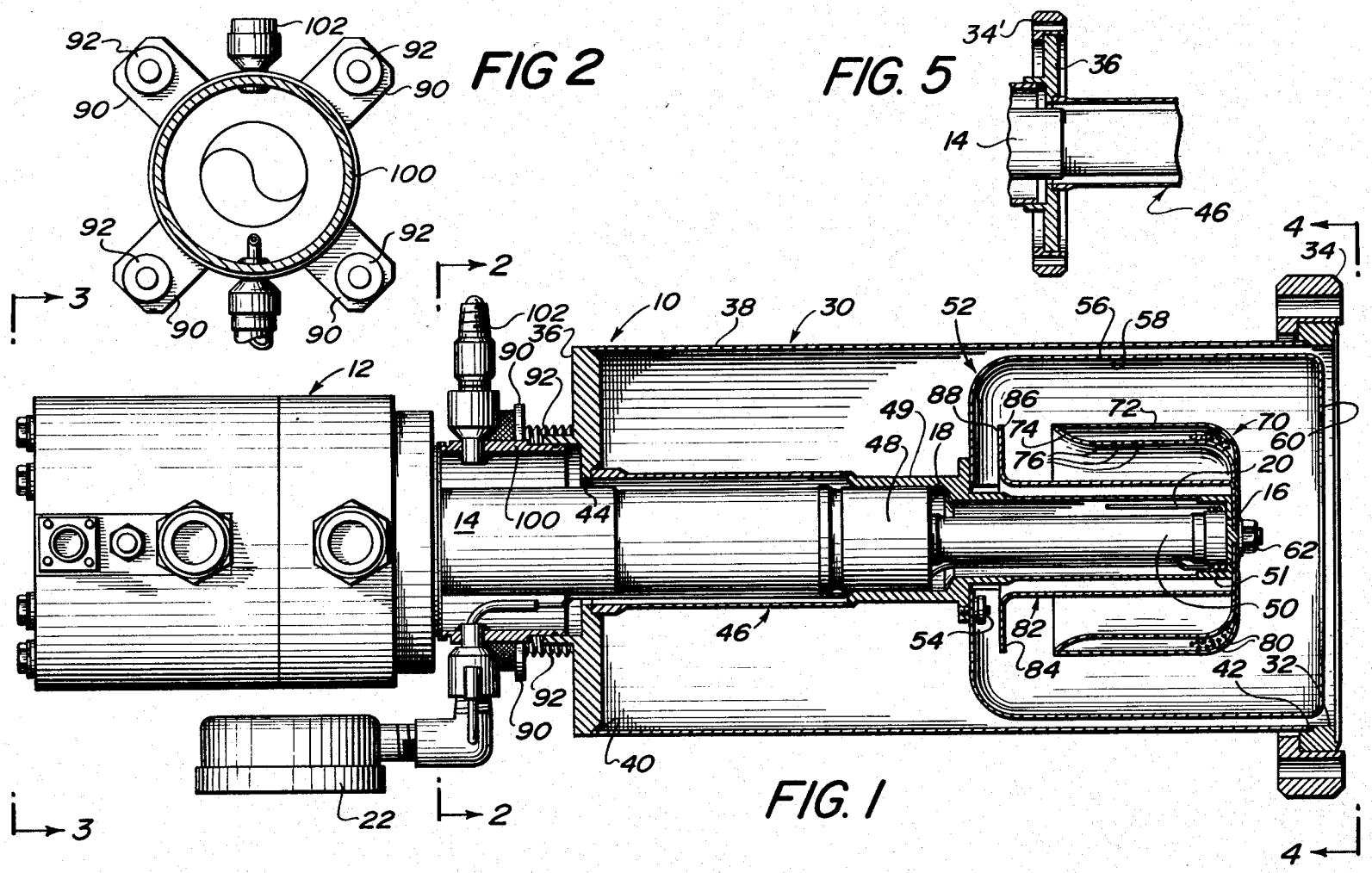
FIG. 1 is a front elevational view partially in section of a cryopump and refrigerator according to the present invention.
FIG. 2 is a view taken along the lines 2—2 of FIG. 1.
FIG. 5 is a fragmentary front elevational view partially in section of an alternate embodiment of a cryopump and refrigerator according to the present invention.
Figure 3:
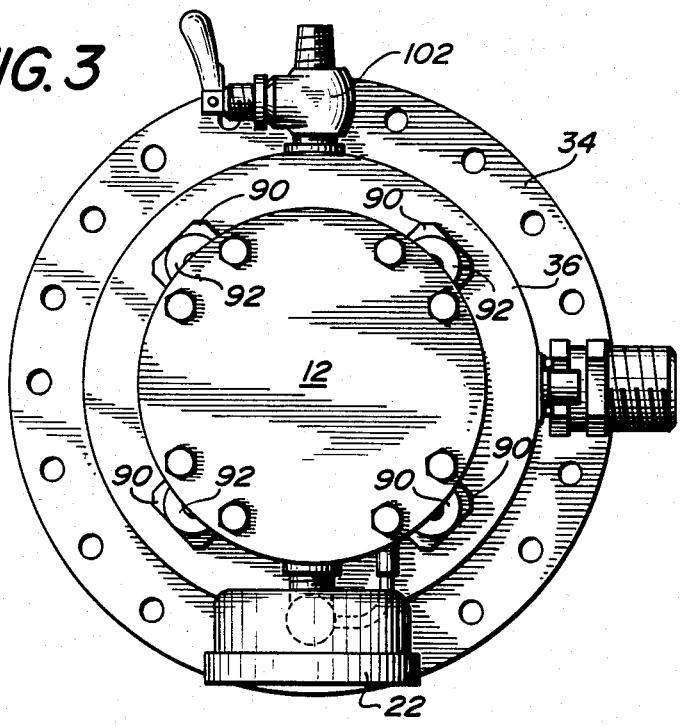
FIG. 3 is a view taken along the lines 3—3 of FIG. 1.

Referring to FIG. 1 the cryopump assembly shown generally as 10 includes a cryogenic refrigerator 12 having a two-stage displacer expander 14 capable of producing two levels of refrigeration at the second stage or cold end 16 and the first or warm stage 18 respectively of approximately 12° K. and 40° K. Refrigerator 12 is described in detail in U.S. Pat. No. 3,620,029 the specification of which is incorporated herein by reference. Refrigerators of this type are offered for sale by Air Products and Chemicals, Inc. under the designation of Model CS202. In the particular application to high vacuum chambers, refrigerator 12 is fitted with a hydrogen vapor bulb temperature sensor 20 and hydrogen vapor bulb temperature gauge 22 as is well known in the art. Other instrumentation can also be provided depending upon the particular application for which the cryopump is to be used.

Cryopump 10 includes a cryopump housing 30 which has a first end 32 which is adaptable to mate with a ultra-high vacuum test chamber through means of a vacuum flange 34 as is well known in the art. The second end of the cryopump housing 30 is closed by a plate or closure 36 which can be fastened to the cylindrical shell 38 by a fusion weld 40 as is well known in the art. Similarly, flange 34 can be fixed to cylinder 38 by a fusion weld 42. Plate 36 contains a central aperture 44 which receives a refrigerator housing 46. The refrigerator housing is made of a metal having a stepped down cross-sectional configuration to receive the complementary shaped expander portion 14 of refrigerator 12 as is shown. Cylindrical housing 46 is adapted for a slip fit connection between the refrigerator expander warm stage 48 and the warm stage adaptor 49 of housing 46 as shown in the drawing. Housing 46 is further adapted to have a surface contact with cold end 50 of refrigerator 12 as is shown, thus achieving thermal contact at two specific locations on the refrigerator housing 46 with two distinct temperature levels of the expander portion 14 of the refrigerator 12. Heat stations 49 and 51 which are copper are electron beam welded to the housing 46 which is stainless steel.

Figure 4:
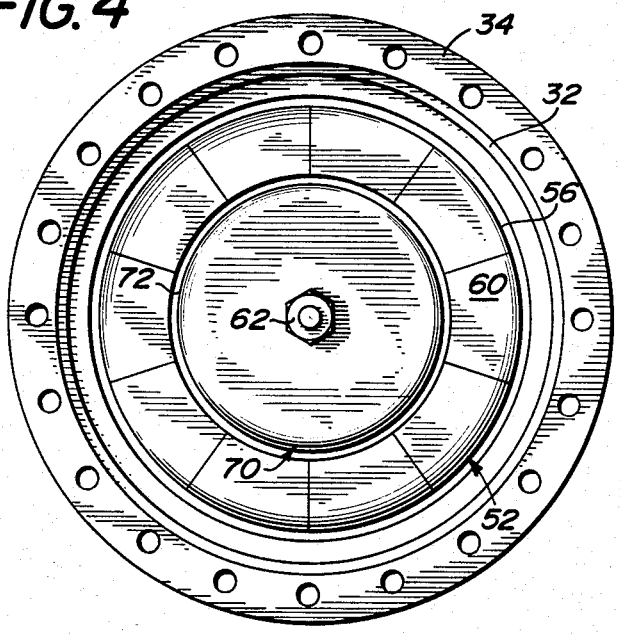
FIG. 4 is a view taken along the lines 4—4 of FIG. 1.

Fixed to heat station 49 of the refrigerator housing 46 is a first cryopanel 52 which is fabricated of a highly conductive metal such as copper and in the configuration of an open top cylinder with an apertured bottom so that the cryopanel 52 can be fixed to warm stage 49 of the refrigerator housing as by bolts and nuts, one being shown generally as 54 in FIG. 1. Warm stage cryopanel 52 has its outer surface 56 coated with a highly reflective coating produced by known techniques such as bright nickel plating. Interior surface 58 of warm stage cryopanel 52 is coated with a radiation absorbent coating (e.g. black chrome oxide) to prevent any incident radiation from being reflected into the interior of the cryopump as will be more fully explained hereinafter. The upper end 60 of warm panel 52 is folded over much like the petals of a flower as illustrated in FIG. 4 so as to further prevent radiation from reaching the interior of the cryopump.

Fixed to the heat station 51 of refrigerator housing 46 by a suitable stud and nut 62 is a cold panel 70 also fabricated from a highly conductive metal such as copper with its outside surface containing a bright nickel plating and its interior surface having a radiation absorption coating such as black chromium oxide.

Interiorly on cold panel 70 is a retainer 74 in the form of an expanded metal such as a screen having a radiation absorption coating which is formed to provide an envelope between it and the cold panel 70 wherein charcoal 80 is disposed in loose granular form in order to pump hydrogen as will be more fully described hereinafter. Interior panel 74 contains a plurality of aperatures 76 so that the hydrogen molecules can pass through and be absorbed on the charcoal.

A third panel 82 in the form of a cylinder with an out-turned lip 84 also fabricated from a highly conductive metal such as copper with its outer surface 86 having a radiation absorbing coating such as black chromium oxide plated thereon is fixed to heat station 51 between cold panel 70 and warm stage cryopanel 52. Inner surface 88 of panel 82 can be bright chromium plated at the user's option. Third panel 82 is included to further shield the charcoal from incident radiation and to thereby increase pumping speed of the cryopumps affixed to the heat station 51 of the refrigerator housing 46.

Referring back to FIG. 2, the refrigerator contains a plurality of lugs 90 disposed equidistantly around its cylinder which lugs contain aperatures which can receive bolts or cap screws 92 to fix the refrigerator 12 to the cover of 36 to achieve a gas tight seal. Refrigerator 12 includes a transition collar 100 and gas port 102 so that when the refrigerator 12 is fixed to the cryopump housing 30 a gas such as helium can be introduced into the space between the refrigerator displacer expander section 14 and the refrigerator housing 46 at approximately 1 atmosphere to provide a heat exchange medium between the refrigerator and the various stages of cooling of the refrigerator housing 46.

Cryopump housing 30 can be fabricated using only bolted or fusion welded connections so that no materials are used that will excessively outgas during use. As pointed out above, the cylindrical portion of the cryopump housing 48 and the cover 46 as well as the flange are most generally fabricated from stainless steel which contains residual hydrogen from the steel manufacturing process. At extremely low pressures, the hydrogen outgasses from the stainless steel and must be pumped on the charcoal. In order to pump hydrogen at low pressures on the charcoal the charcoal must be cooled to a very low temperature, e.g. 12° K. The charcoal must be shielded from incident radiation in order to be effectively cooled and pump the residual hydrogen. The use of the three panel configuration with polished surfaces to pump water, oxygen, nitrogen, and argon so they do not reach the charcoal and radiation absorption surfaces on the first and third cryopanels to prevent incident radiation from reaching the charcoal achieves the optimum cooling of the charcoal. However, before high vacuums can be achieved, water and other gases which are adsorbed on the interior surfaces at room temperature must be removed from the cryopump before it is cooled down. In order to do this the cryopump must be heated to 250° C. or above while under vacuum in order to remove or bake out the adsorbed gases. To achieve baking of the cryopump 10, the refrigerator 12 with its associated instrumentation is removed from the cryopump housing 30 by removing bolts 92 and sliding the refrigerator out of the refrigerator housing 46 (e.g. moving it to the left in FIG. 1). A heater can then be wrapped around the cryopump housing and test chamber and the entire assembly heated to a temperature of approximately 250° C. As the test chamber and cryopump are heated, the chamber is pumped with an ion pump or a cryopump to establish a pressure of approximately $1\times10^{-6}$ Torr while the enclosure is hot. Pumping is then stopped, all valves are closed and the system is allowed to cool back to room temperature. After being cooled to room temperature, refrigerator 12 is reinstalled into the cryopump housing 30 using bolts 92 and the space between the refrigerator and the refrigerator housing 46 is evaucated from 1 atm to approximately $1\times10^{-2}$ Torr. The refrigerator housing 46 is then backfilled with helium via fitting 102 to provide the heat exchange gas. After this, the refrigerator can be activated and the cryopanels cooled down to their operating temperatures.

While not necessary, the lip 60 on warm panel 52 and the lip 84 on cold panel 82 help to prevent residual water, carbon dioxide, nitrogen, oxygen, argon, carbon monoxide, methane and freon, if they are present, from contacting the charcoal 80.

FIG. 5 shows an alternate embodiment of a cryopump assembly according to the present invention. Like numbers have been used in FIG. 5 to identify like parts between the embodiments of FIGS. 1 and 5. The cryopump assembly includes the cryogenic refrigerator having a displacer expander 14 capable of producing two levels of refrigeration.

The cryopump of FIG. 5 includes a vacuum flange 34' which is adapted by welding or other fastening techniques to receive plate 36 which in turn has affixed thereto refrigerator housing 46. Refrigerator housing 46 and the associated cryopanels are identical to these as described in relation to the apparatus of FIGS. 1–4. The major and only difference between the embodiments of FIGS. 1 and 5 is the elimination of cylindrical shell 38 for the apparatus of FIG. 1. Shell 38 is used to, in effect, extend the volume of the vacuum chamber by keeping the cryopump outside of the vacuum chamber proper.

A bakeable cryopump according to the present invention has solved the problems of the prior art by achieving a device having the following features:

1. Mounting of the expander in a separate cylinder from which it can be removed while the cylinder with cryopanels attached is subject to the baking operation.

2. Thermal engagement of the expander and cylinder is accomplished by having close contact between highly conductive heat stations at the first and second stages and maintaining zero psig of helium pressure around the expander to facilitate conductive heat transfer.

3. Instrumentation, e.g., a hydrogen vapor bulb temperature gauge, can be attached to the refrigerator and removed with it so it does not have to be able to withstand the baking temperature. Other instrumentation can also contain materials which are imcompatible with high vacuum systems since they are separated from the vacuum space by the refrigerator housing. The refrigerator and its materials of construction cannot be a source of ignition of combustible gases and cannot be attacked by corrosive gases since they are isolated from the vacuum.

4. Brazing alloys are not used, thus eliminating a source of contaminants to the vacuum chamber, the stainless steel to copper joints being made directly by electron beam welding.

5. Charcoal is retained in a basket which is part of the cold cryopanel rather than being fixed to the coal panel by epoxy as is conventionally done, thus eliminating another source of contaminant to the vacuum.

6. Silver gaskets can be used to obtain good thermal contact where the cryopanels are attached to the refrigerator housing.

7. The warm cryopanel is constructed so there are no joints by folding over the inlet flange like the petals on a flower to further prevent gases from striking the charcoal.

8. Cryopanels are fabricated from highly conductive metals, such as copper, which are nickelplated to reflect radiation on the outside and coated with a black chromium oxide on the inside where radiation absorbing surfaces are desired.

Having thus described our invention, what is desired to be secured by letters patent of the United States is set forth in the appended claims.

What is claimed:

1. A bakeable cryopump comprising in combination: a flange designed for mounting said cryopump to a vacuum chamber normally operated at vacuums of $10^{-10}$ torr or below; a generally cylindrical refrigerator housing fixed to said flange, said refrigerator housing designed and arranged to receive a two-stage displacer-expander refrigerator head so that a coldest stage of said refrigerator head can be brought in thermal contact with a closed end of said refrigerator housing said refrigerator removable from said housing without loss of vacuum inside said cryopump, said refrigerator housing further designed and arranged in combination with a thermal transfer media contained in said housing at approximately 1 atmosphere pressure to thermally contact a warmer stage of said refrigerator; at least one cryopanel fixed to said closed end of the refrigerator housing said cryopanel including means to minimize radiant heat loads and to cryopump hydrogen, said housing and said cryopanel fabricated from materials and by methods to minimize out-gassing of the structure under vacuum; said refrigerator head being designed to be readily removed from said refrigerator housing and said cryopump housing heated to temperatures above 200° C. under vacuum conditions to remove adsorbed gases from said cryopanel.

2. A cryopump according to claim 1 wherein said thermal transfer media is helium.

3. A cryopump according to claim 1 wherein there is included two cryopanels on said closed end of said refrigerator housing one of said panels having disposed thereon an adsorbent.

4. A cryopump according to claim 1 or 3 wherein said cryopanels are fabricated from highly conductive metal, said panels plated with a radiation reflective metal on the outside surface and having a radiation absorbing coating on the inside surface.

5. A cryopump according to claim 1 wherein said refrigerator housing is fabricated from stainless steel with copper heat station.

6. A cryopump according to claim 1 wherein a cryopanel is fixed to the portion of said refrigerator housing in thermal contact with the warmer stage of said refrigerator and is of a generally cylindrical shape extending beyond the first end of said refrigerator housing with an inwardly turned flange shaped portion on said terminating end.

7. A cryopump according to claim 1 wherein the materials of construction are selected to minimize outgassing at ultra high vacuum levels.

8. A bakeable cryopump comprising in combination: a generally cylindrical cryopump housing having a first end containing a flange designed for mounting said cryopump housing to a vacuum chamber normally operated at vacuum of $10^{-10}$ torr or below and a second end having thereon a closure; said closure having a generally cylindrical refrigerator housing extending longitudinally inside said housing from said second end toward said first end, said refrigerator housing designed and arranged to receive a two-stage displacer-expander refrigerator head so that a first or cold stage of said refrigerator head can be brought in contact with a closed end of said refrigerator housing, said refrigerator housing further designed and arranged to contact a second stage of said refrigerator in a slip fit manner; at least one cryopanel fixed to said closed end said cryopanel containing an adsorbent to cryopump hydrogen, said adsorbent fixed in relation to said panel by means, designed to maintain said adsorbent at the temperature of the cold stage of said refrigerator and a second cryopanel fixed to the portion of the refrigerator housing where said refrigerator head engages said refrigerator housing in the slip fit manner said second panel designed to prevent heat radiation to said adsorbent, said housing and said cryopanels fabricated from materials and by methods to minimize out-gassing of the structure under operating vacuums; said refrigerator head is designed to be readily removed from said refrigerator housing without loss of vacuum in said cryopump and said cryopump housing can be heated to temperatures above 200° C. under vacuum conditions to remove pumped gases from said cryopanels.

9. A cryopump according to claim 8 wherein said refrigerator housing includes means to surround said refrigerator with a thermal transfer media at essentially 0 psig.

10. A cryopump according to claim 8 wherein there is included two cryopanels on said closed end of said refrigerator housing one of said panels having disposed thereon an adsorbent.

11. A cryopump according to claim 8 to 10 wherein said cryopanels are fabricated from a material of high thermal conductivity, said panels plated with a radiation reflective metal on the outside surface and having a radiation absorbing coating on the inside surface.

12. A cryopump according to claim 8 wherein said cryopump housing is fabricated from stainless steel.

13. A cryopump according to claim 8 wherein said cryopanel fixed to the slip fit portion of said refrigerator housing is of a generally cylindrical shape extending toward the first end of said housing terminating before the first end of said housing and having an inwardly turned flange shaped portion on said terminating end.

14. A cryopump according to claim 8 wherein said refrigeration is transferred from said refrigerator head to said housing by means of convective heat transfer.

* * * * *